US006718963B1

(12) United States Patent
Wheeler

(10) Patent No.: US 6,718,963 B1
(45) Date of Patent: Apr. 13, 2004

(54) COMPOUND ARCHERY BOW CONSTRUCTION AND METHODS OF MAKING AND OPERATING THE BOW

(75) Inventor: Mark G. Wheeler, Farwell, MI (US)

(73) Assignee: Mark Wheeler, Farwell, MI (US)

( * ) Notice: Subject to any disclaimer, the term of this patent is extended or adjusted under 35 U.S.C. 154(b) by 0 days.

(21) Appl. No.: 10/047,644

(22) Filed: Jan. 15, 2002

Related U.S. Application Data

(60) Provisional application No. 60/261,851, filed on Jan. 15, 2001.

(51) Int. Cl.[7] ..... F41B 5/10
(52) U.S. Cl. ..... 124/25.6; 124/900
(58) Field of Search ..... 124/25.6, 900

(56) References Cited

U.S. PATENT DOCUMENTS 5,687,703 A * 11/1997 Vyprachticky ..... 124/25.6
5,749,351 A 5/1998 Allshouse et al.
5,782,229 A * 7/1998 Evans et al. ..... 124/25.6
5,975,067 A 11/1999 Strother
6,035,841 A 3/2000 Martin et al.
6,082,346 A 7/2000 Andrews et al.

OTHER PUBLICATIONS

High Country Archery, Inc. Ad Sheet—Vibra Damp Pocket—one page—2000.
Browning Ad Sheet—No One Dampens Vibration Better than Browning—one page—2001.
Mathews Ad Sheet—Q2—one sheet.

* cited by examiner

*Primary Examiner*—John A. Ricci

(57) ABSTRACT

An eccentric pulley assembly is provided for a compound bow, including an eccentric base cam having a peripheral track for letting out a draw string as the bow is drawn. A power cam secured to the base cam has a cable track for taking up a power cable as the bow is drawn and a shoulder is provided for spacing the track of the base cam from the track of the power cam.

2 Claims, 21 Drawing Sheets

COMPOUND ARCHERY BOW CONSTRUCTION AND METHODS OF MAKING AND OPERATING THE BOW

This application claims the priority of provisional application, Ser. No. 60/261,851 filed Jan. 15, 2001. The invention relates to archery bows and more particularly to compound archery bows utilizing separable limb and riser components.

BACKGROUND OF THE INVENTION

One of the problems with achieving accuracy has been the recoil vibration occurring as the arrow is released from the bow, which has resulted also in undue noise which startles the game. Another factor affecting accuracy is the alignment of the bow string which in the past has not provided the balance desired. To the best of my knowledge, the arrow released by prior art compound bows has not been vertically centered with the result that the torque and flex stresses on the bow upper and lower limbs has not been balanced, and accuracy has been sacrificed as a result. Moreover, the bow string has not been centered in the sense of vertical upper and lower pulley alignment and in the sense of vertical bisection of the handle.

Typical archery bows of the type presently utilized are disclosed in U.S. Pat. No. 5,975,067 issued Nov. 21, 1999, U.S. Pat. No. 6,035,841 issued Mar. 14, 2000, U.S. Pat. No. 6,082,346 issued Jul. 4, 2000, and U.S. Pat. No. 5,749,351 issued May 12, 1998 wherein the compound bow utilizes eccentric pulleys on the outer ends of the limbs to facilitate the draw and the arrow release. The present invention is directed to bows of this general character.

SUMMARY OF THE INVENTION

The present invention, in one aspect thereof, is concerned with the manner of mounting the resilient limbs to the handle riser as well as to the vertically centered alignment of the pulleys mounting the bow string along with the handle, and the positioning of the bow rest to achieve a vertically centered arrow relationship. This permits the archer to utilize a better balanced bow which is more accurate. Because of the balanced relationship achieved, the archer is presented with less torqueing stresses in the bow and less vibration is transferred via the bow limbs upon limb recoil and arrow release. Moreover, the positioning of the arrow in vertically centered position provides equal torque and flex forces on the limbs to generate more stored energy as the bow string is drawn. Another aspect of the invention is the provision of eccentric pulley assemblies which aid in achieving these desired characteristics.

A further object of the invention is to provide a limb mounting system which results in material vibration reduction and accordingly much less noise generation in the release of the arrow. This is accomplished by securing the limb inner ends to the handle riser ends by means of a novel vibration damping assembly. A limb bolt extends into a threaded vibration damping member carried by the riser at each end and a limb cup, constructed of anti-vibration material, is snugly utilized between the seat and the sides and inner end, as well as the bottom, of each limb. The installed cushioning limb cup restricts the limb from shifting laterally, and forwardly or inwardly, while permitting the limbs to flex or unflex when the archer adjusts the attachment bolt to his desired draw requirements and thereby controls the energy which will be stored in the deflected resilient limbs when the bow string is drawn.

DETAILED DESCRIPTION OF THE PREFERRED EMBODIMENT

Figure 1:
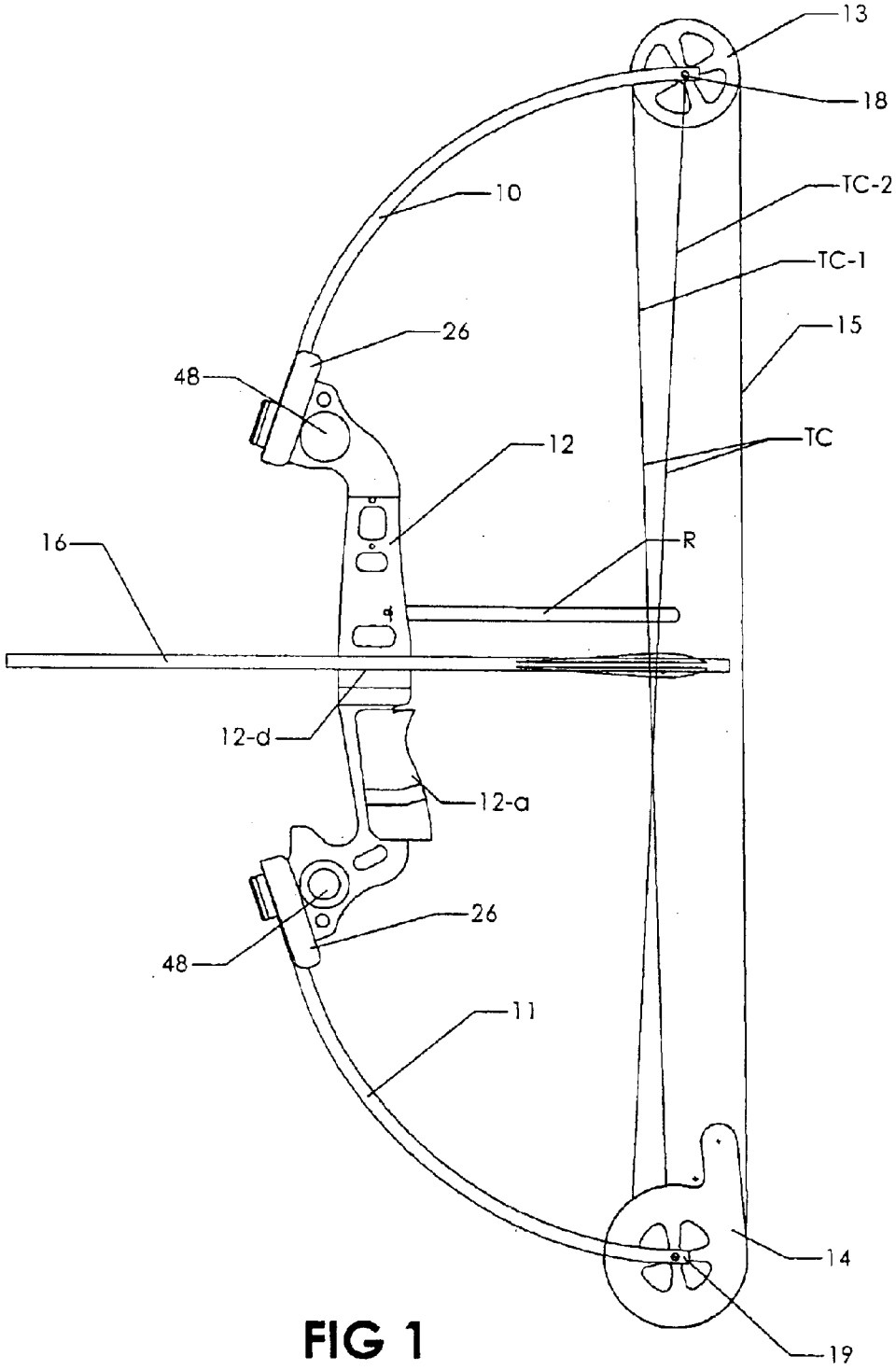
FIG. 1 is a side elevational view of a relaxed compound single-cam archery bow utilizing the present inventive concepts.
Figure 2:
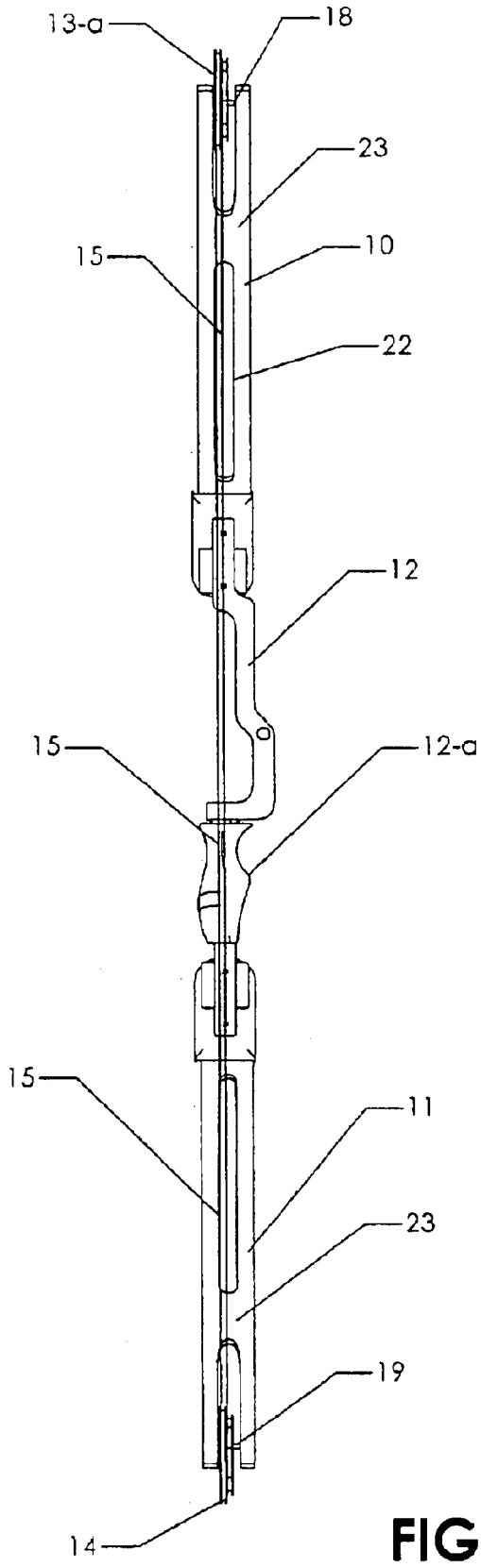
FIG. 2 is a rear elevational view of a dual cam bow with the tensioning cable system omitted, illustrating various components of the bow shown in FIG. 1.

Referring more particularly to the accompanying drawings, and in the first instance to FIG. 1 thereof, the bow assembly comprises generally upper and lower resilient limbs generally designated 10 and 11 joined in the manner to be disclosed to a rigid riser, generally designated 12, which can be fashioned of aluminum or other suitable material. Revolvable mechanical advantage creating pulley members 13 and 14 are mounted laterally centrally at the outer ends of the limbs 10 and 11. The members 13 and 14 may comprise regular idler pulleys or eccentric pulleys and in FIG. 1 a regular pulley is shown at 13 and an eccentric pulley at 14. They operate in the usual manner to mount the bow string 15 shown in FIG. 1, which in the embodiment shown is part of the conventional tension cable system generally designated TC which extends between the opposite ends of the bow in the usual manner. The cables TC-1 and TC-2 of the conventional cable system, pass through spaced apart openings in a cable guard rod r which holds the cables laterally apart and displaced sufficiently from arrow 16 to avoid feather damage. Here the cable TC-1, which provides the bow string portion 15, passes around pulley 13 and pulley 14 and secures at both ends to eccentric pulley 14. Cable TC-2 is shown as connected to limb 10 at one end and to the pulley 14 at the other. In FIG. 2, a conventional eccentric pulley is used in the upper end of the bow at 13*a* and on the lower end of the bow at 14. It will be noted that the arrow 16 is vertically centered with respect to the axes of axles 18 and 19 on which the pulleys 13 or 13*a* and 14 are mounted for rotation. This tends to prevent the bow from tilting vertically on the draw.

Figure 3:
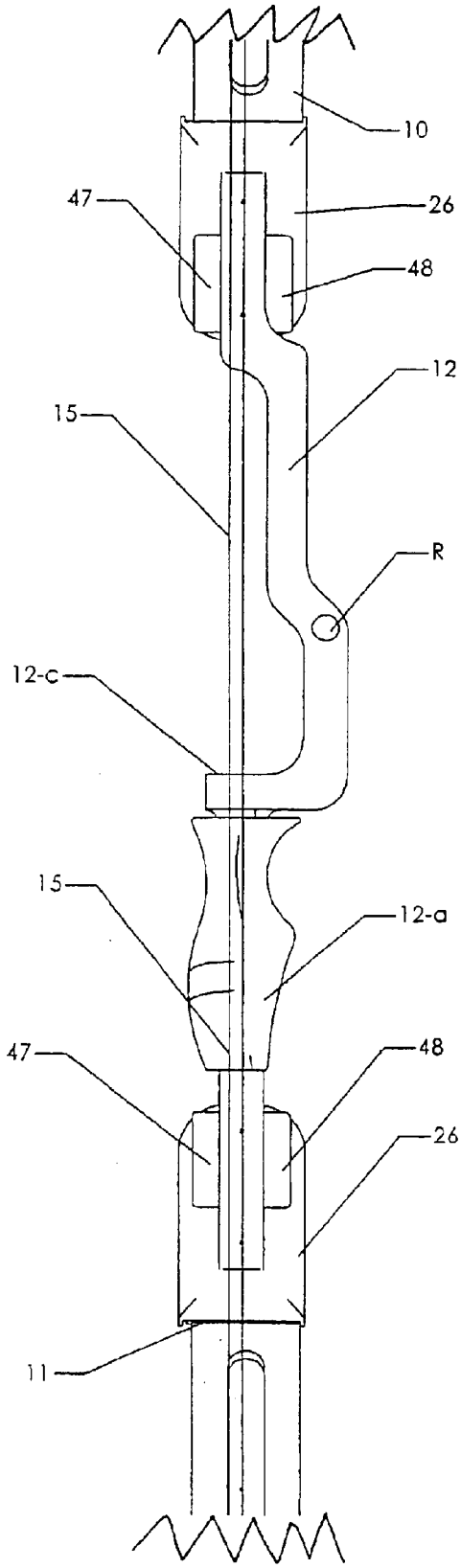
FIG. 3 is an enlarged fragmentary rear elevational view illustrating the relationship of the handle and bow string in more detail.
Figure 4:
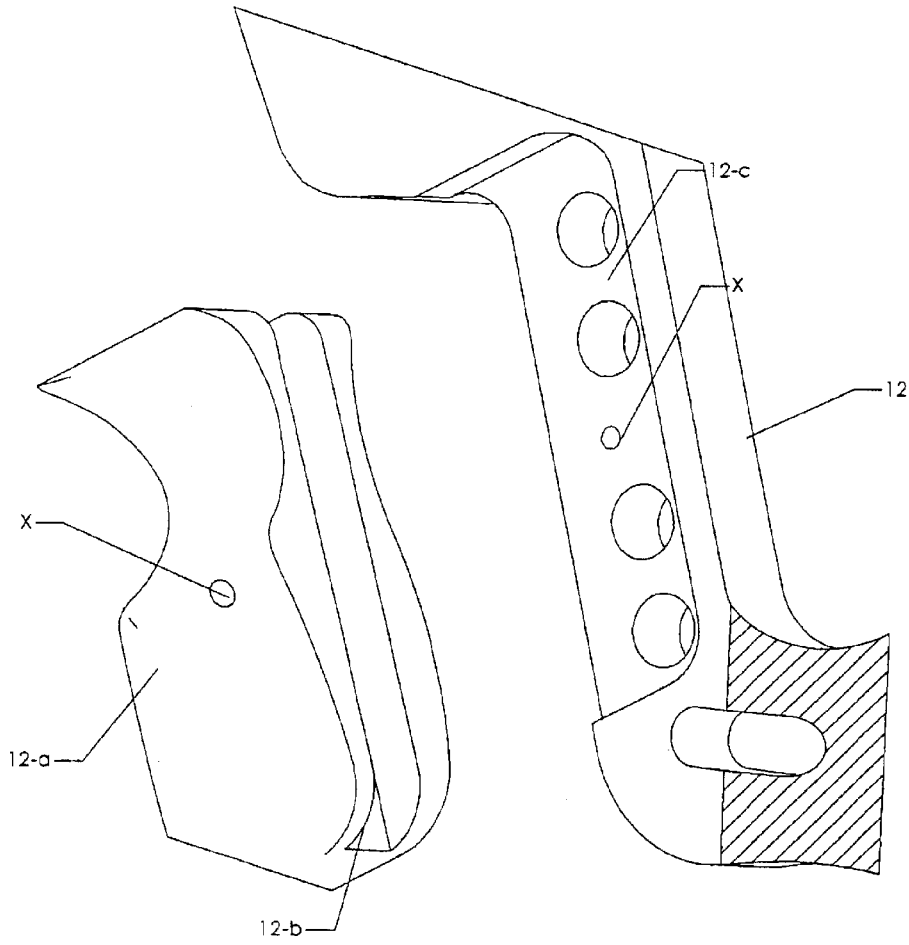
FIG. 4 is an enlarged perspective view of the handle illustrating the handle recess which mounts on the riser in a manner to provide the top to bottom centering of the bow string.
Figure 5:
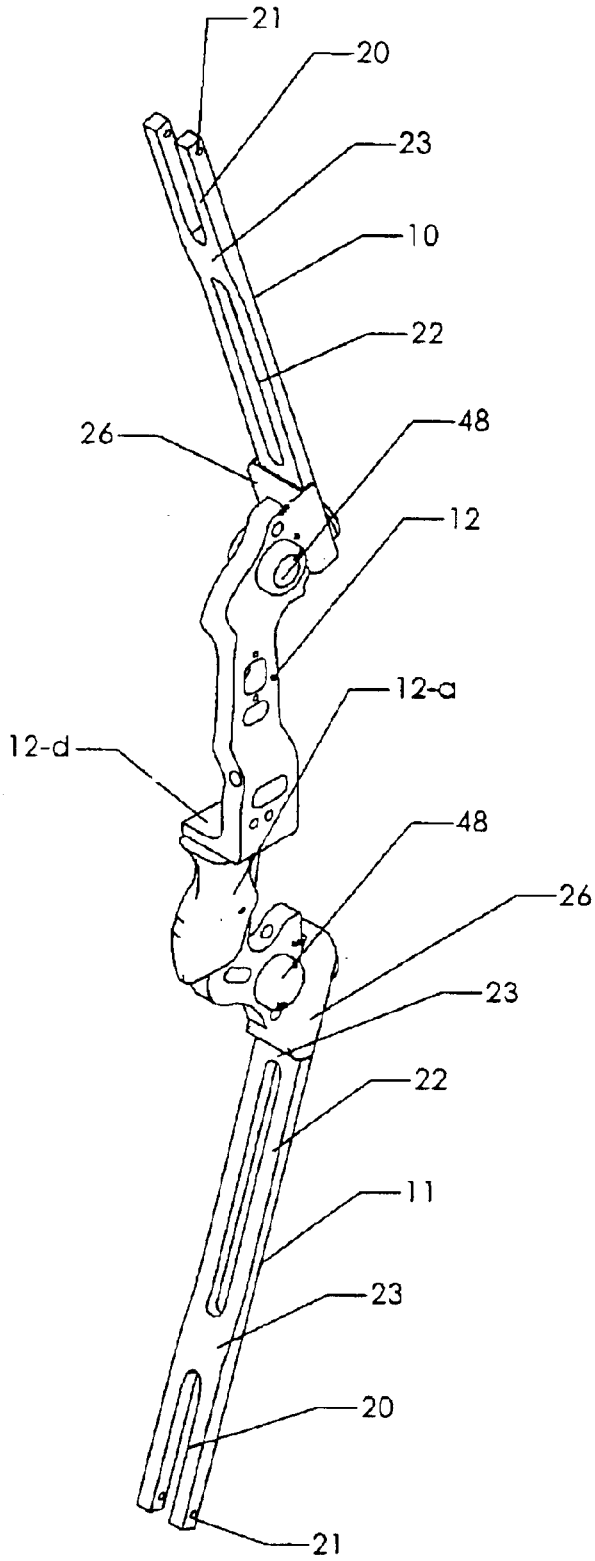
FIG. 5 is a somewhat enlarged side elevational view of the limb and riser assembly only.
Figure 6:
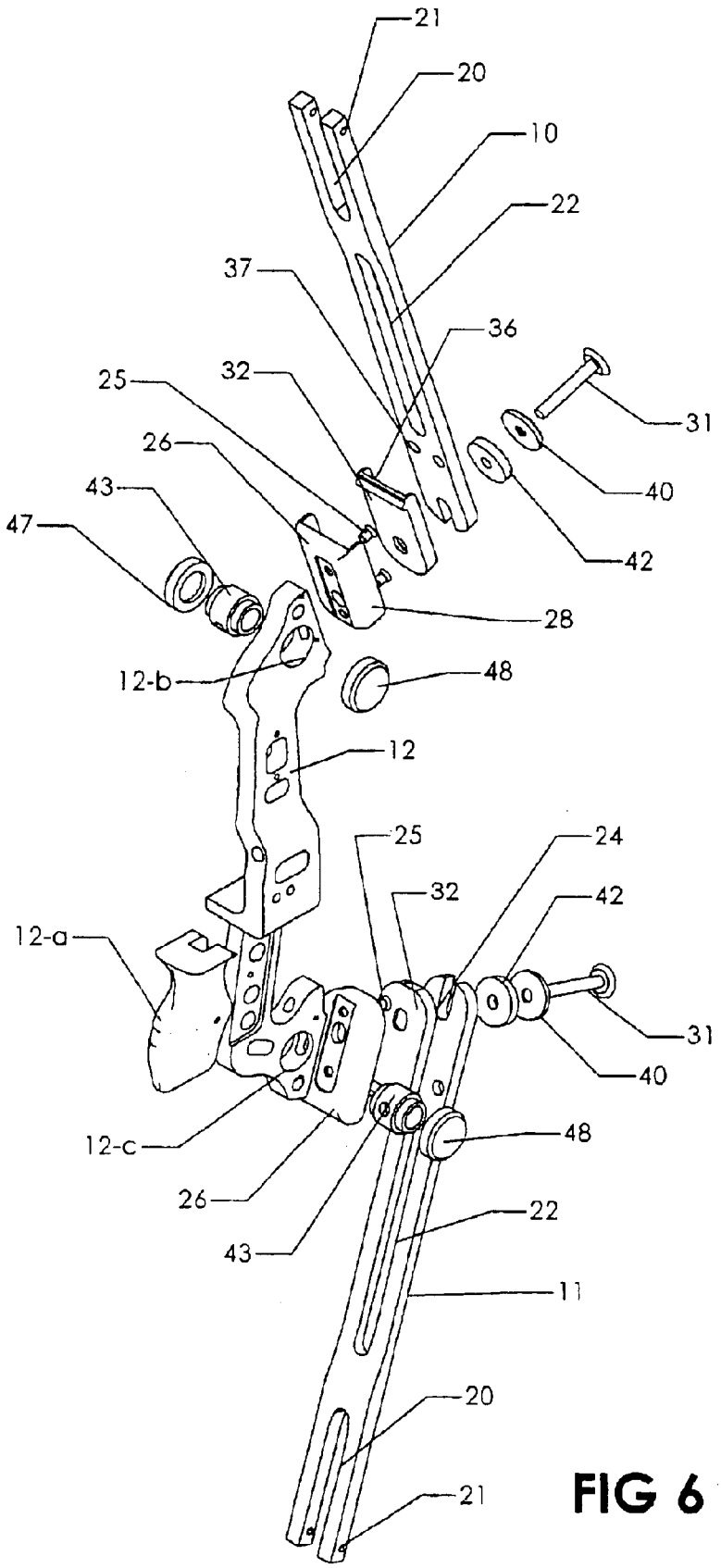
FIG. 6 is an exploded view thereof on a slightly enlarged scale showing the various component parts thereof.

As FIG. 3 further indicates, the pulleys 13 or 13*a* and 14 are so aligned vertically, and the handle 12*a* is so mounted on the riser 12, that the string 15 vertically bisects the bow handle 12*a* in a front to rear direction. While the bow string 15 is offset with respect to the mid-portion of the riser, it is substantially centered with respect to the handle 12*a,* as FIG. 3 particularly indicates. This is possible because the vertical mounting recess 12*b* (FIG. 7), in the handle 12*a* is centrally offset in the handle to define narrow riser embracing leg 12*g* and wider embracing leg 17*h*. Handle leg 12*h* fits within the recess 12*c* provided in the one side face of the riser 12. Cap screw openings x in the handle and riser, for accommodating a fastener such as a screw, align. Plainly this centering of the bow string 15 with respect to the handle 12*a,* and consequent centering of the string and arrow 16 with respect to the handle 12*a,* can be accomplished alternatively by offsetting the mounting portion of the riser sufficiently that the bow string 15 bisects a handle 12*a* mounted non-eccentrically on the riser 12. The riser 12, as usual, has a number of weight reduction openings and an arrow rest surface 12*d* which is equidistant from the axes of each pulley 13 or 13*a* and 14 and aligns substantially with the vertical center of the bow string 15.

Figure 10:
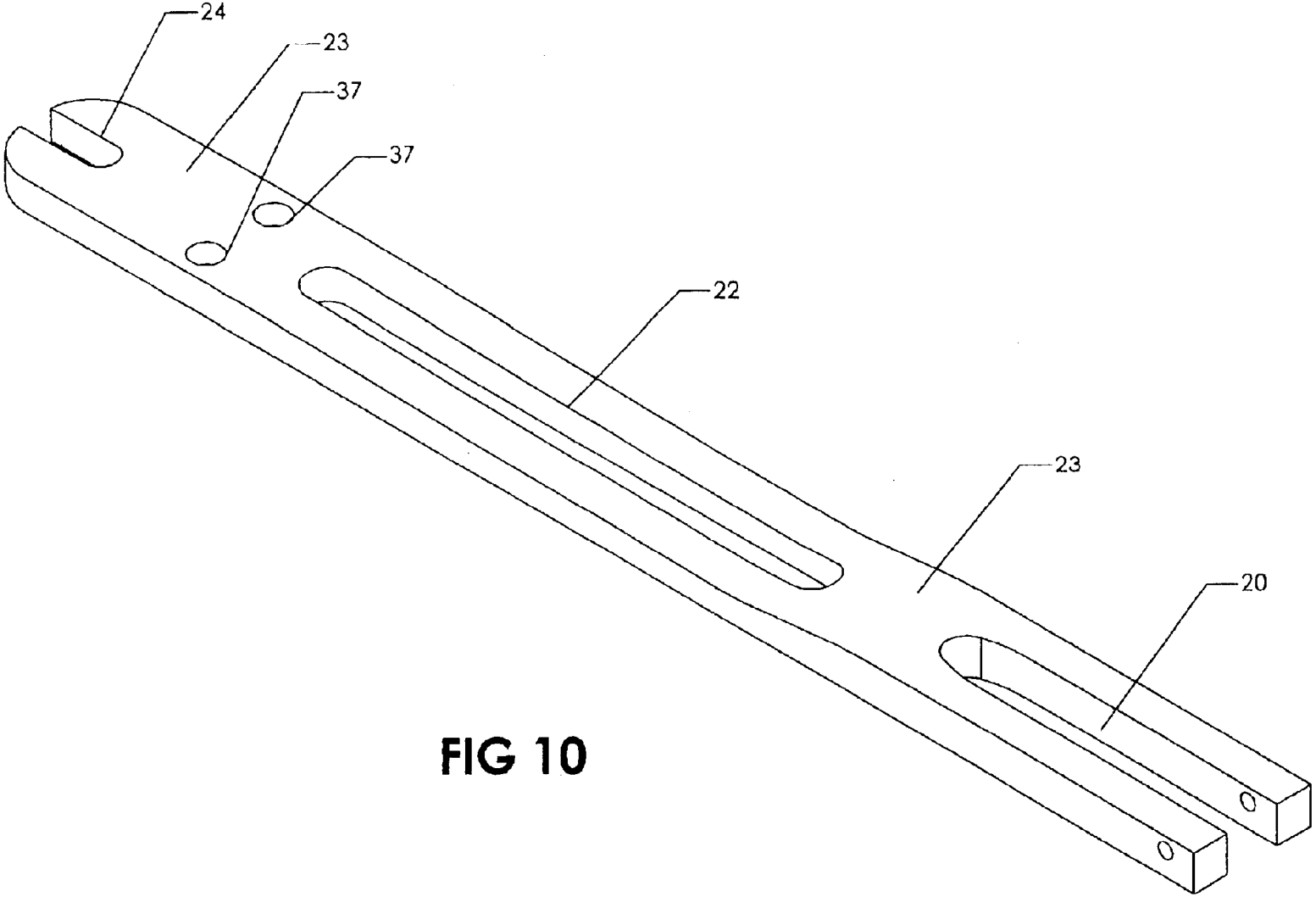
FIG. 10 is an enlarged perspective view of one of the identical limbs.
Figure 10A:
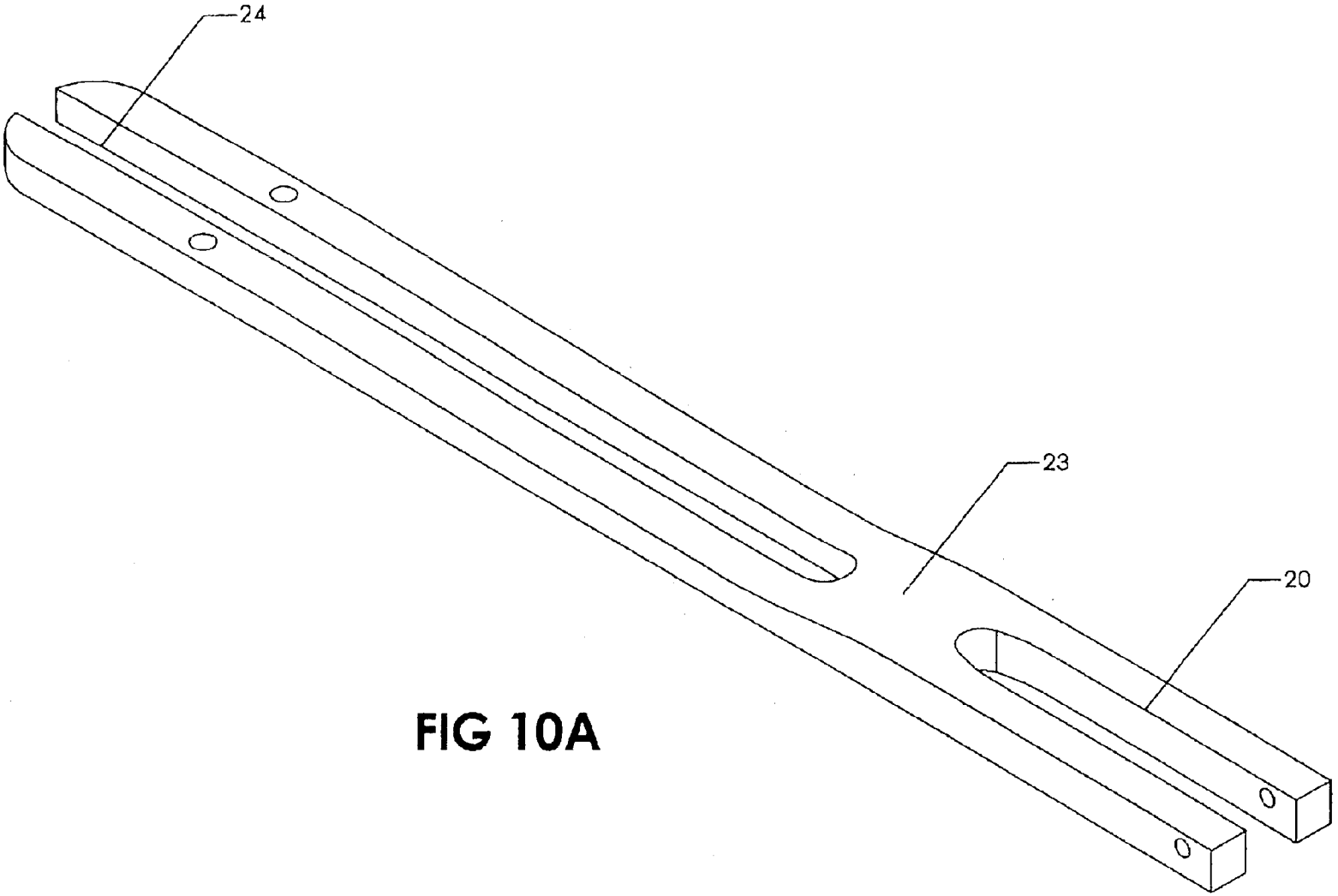
FIG. 10A is a perspective plan view of an alternative limb.

Another important aspect of the present invention is the anti-vibration mounting of the limbs 10 and 11 to the riser as disclosed particularly in FIGS. 6–11. It will be observed that each of the composite material limbs 10 and 11, which are identical, include outer end bifurcation slots 20 within which the inner portions of the pulleys may be rotatably received, and bores 21 for receiving and securing the pulley axle pins 18 and 19. While a mediate slot 22 is provided in each of the limbs in FIG. 10 to increase flexing capability it will be noted that the slot 22 does not extend the full length of the limbs 10 or 11 and, rather, torsion restricting portions 23 are provided at each end of the slot 22, as shown. The inner ends of the limbs 10 and 11 are similarly bifurcated as at 24 (FIG. 7) for a purpose to be presently described. An alternative limb 10 or 11, using like numerals to designate the respective parts, is shown in FIG. 10A.

Bolted to the ends of the riser 12, as with bolts 25, are metallic (preferably aluminum) limb seats or pockets generally designated 26 (FIG. 8) having spaced openings 27 in their recessed bottom walls 26*a* to accommodate the bolts 25 securing the seats 26 to the riser 12 ends. As indicated, the bottom surfaces of seat walls 26*a* have recesses 26*b* (FIG. 7) to receive the protrusion or key portions 12*f* provided on the risers 12 to fit snugly therein. It will be noted that the limb seats or pockets 26 are of an elongate nature and have side walls (see FIG. 6) 28 joined by a generally curvilinear inner end wall 29. The opposite end of each limb seat 26 is open as shown. An elongate opening 30 is also provided in the bottom wall 26*a* of the limb seat to pass a limb attaching metallic (preferably steel) fastener assembly or bolt 31 (FIG. 7) in a manner to be presently described.

Figure 9:
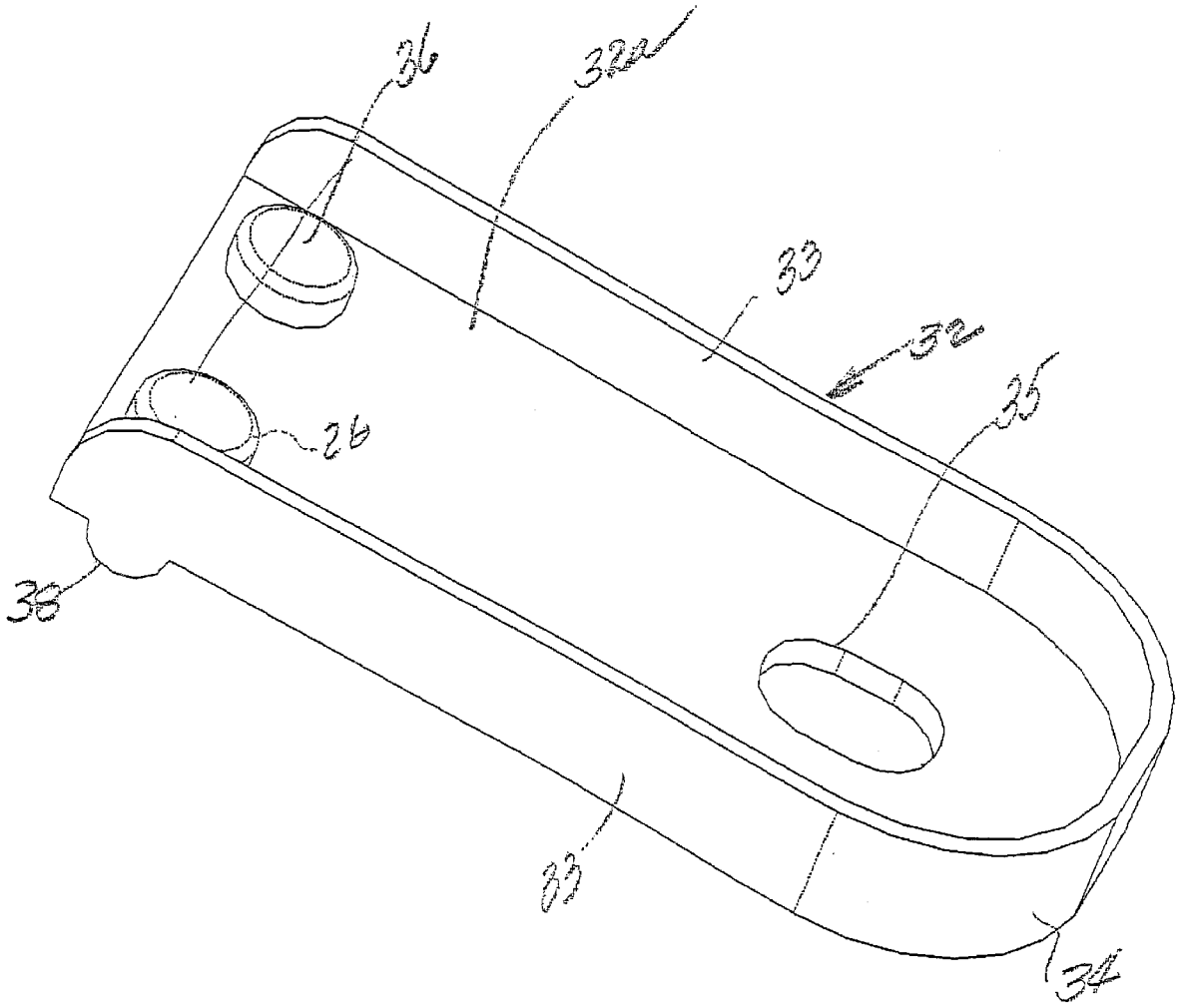
FIG. 9 is an enlarged perspective view of the limb cup which fits in the limb pocket.
Figure 9A:
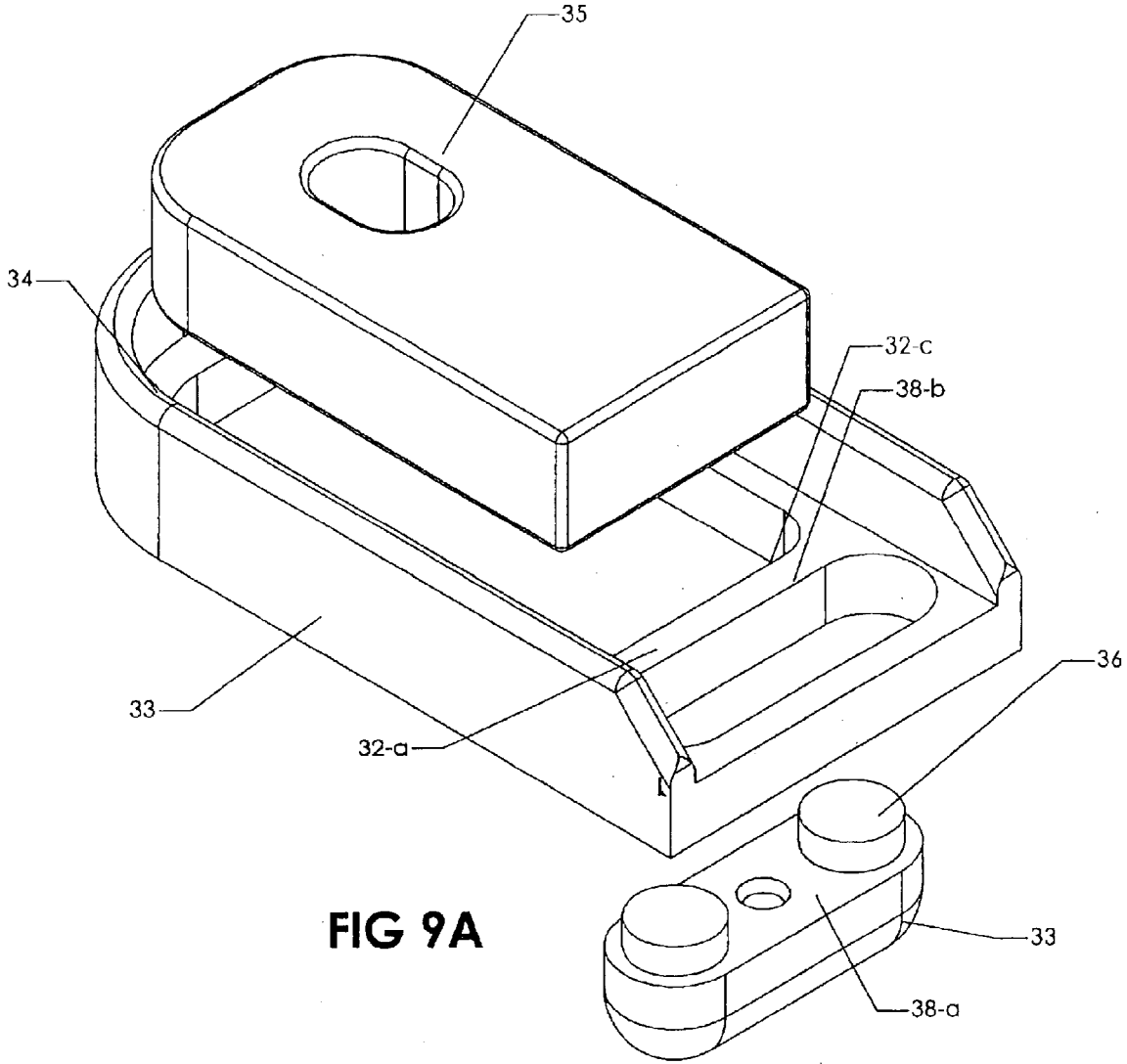
FIG. 9A is an exploded perspective plan view illustrating an alternative limb cup structure.

Provided to seat snugly within the limb seat 26 is a preferably molded, vibration damping limb receptor cup generally designated 32 (FIG. 9) which has similar side walls 33 joined by a similar generally curvilinear end wall 34. Each limb cup 32 includes a bottom wall 32*a* with an elongate opening 35 therein aligning with seat opening 30 to also pass the attachment bolt 31. At its opposite end, the limb cup 32 is open to pass the inner end of the limb and mounts a pair of limb locator bosses 36, as shown, which are received within the spaced apart blind openings 37 (FIG. 10) provided in the bottom surfaces of limbs 10 and 11. The same bosses are provided, but not shown, in FIG. 10A. The walls 33 and 34 of each limb cup are snugly received within and braced by the walls 28 and 29 of the limb seat component 26 with a perimetral clearance of only about 0.005 of an inch. Provided on the limb cups 32 near their outer ends are curvilinear rockers 38 which are received in the curvilinear receiving recesses 39 provided in the seats 26. In addition to permitting some adjustment pivoting when the bolt 31 is adjusted to tension the limbs 10 and 11 to adjust the weight of the bow, they also serve as locator mechanism. It is to be understood that the limb cups 32 are formed of a polyurethane or other suitable resilient synthetic plastic material having a durometer which typically may be 60. The particular durometers mentioned in this application are not to be considered as in any way limiting and other durometers will prove useful so long as they provide the anti-vibration characteristics. A durometer range for the cups 32 is believed to be 30–90. The limbs 10 and 11 are preferably constructed in the usual manner of a composite material such as fiberglass or graphite with embedded fibers which may typically be glass or carbon to provide the requisite strength. The cups 32 need not be completely formed of the same material. In FIG. 9A an improved alternative is disclosed wherein the bosses 36 and rocker 38 are unitarily molded of a harder material such as "delrin plastic". The term Delrin is a trademark owned by E. I. du Pont de Nemours and Co. Inc. for its acetal homopolymer plastics which are mechanically strong while also having resilience. In this version, the upper wall of the rocker is flat as at 38*a* to lie in the same plane as the outer limb receiving surface of the bottom wall when the bosses 36 are inserted up through the opening 38*b* and the rocker 38 is secured in opening 38*b* adhesively, or in any other suitable manner. Another alternative is to cut away part of the cup bottom wall 32*a* as at 32*c* to receive an insert plate 32*d* of material having a lower durometer than wall 32*a*. This lower durometer is in the range 10–30 and preferably about 20.

Figure 7:
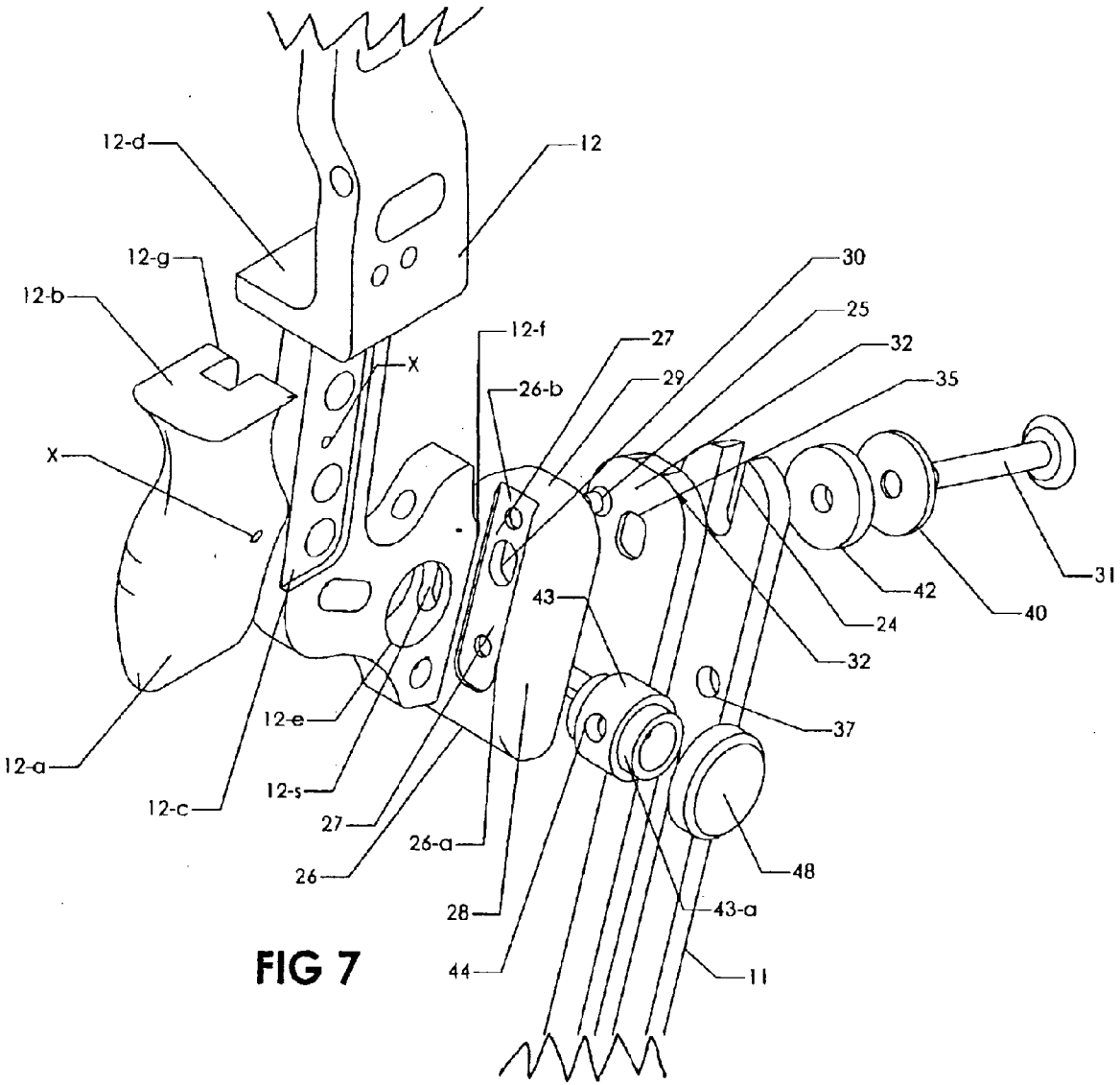
FIG. 7 is a similar exploded view on a more enlarged scale showing the parts at the inner end of the lower limb.
Figure 7A:
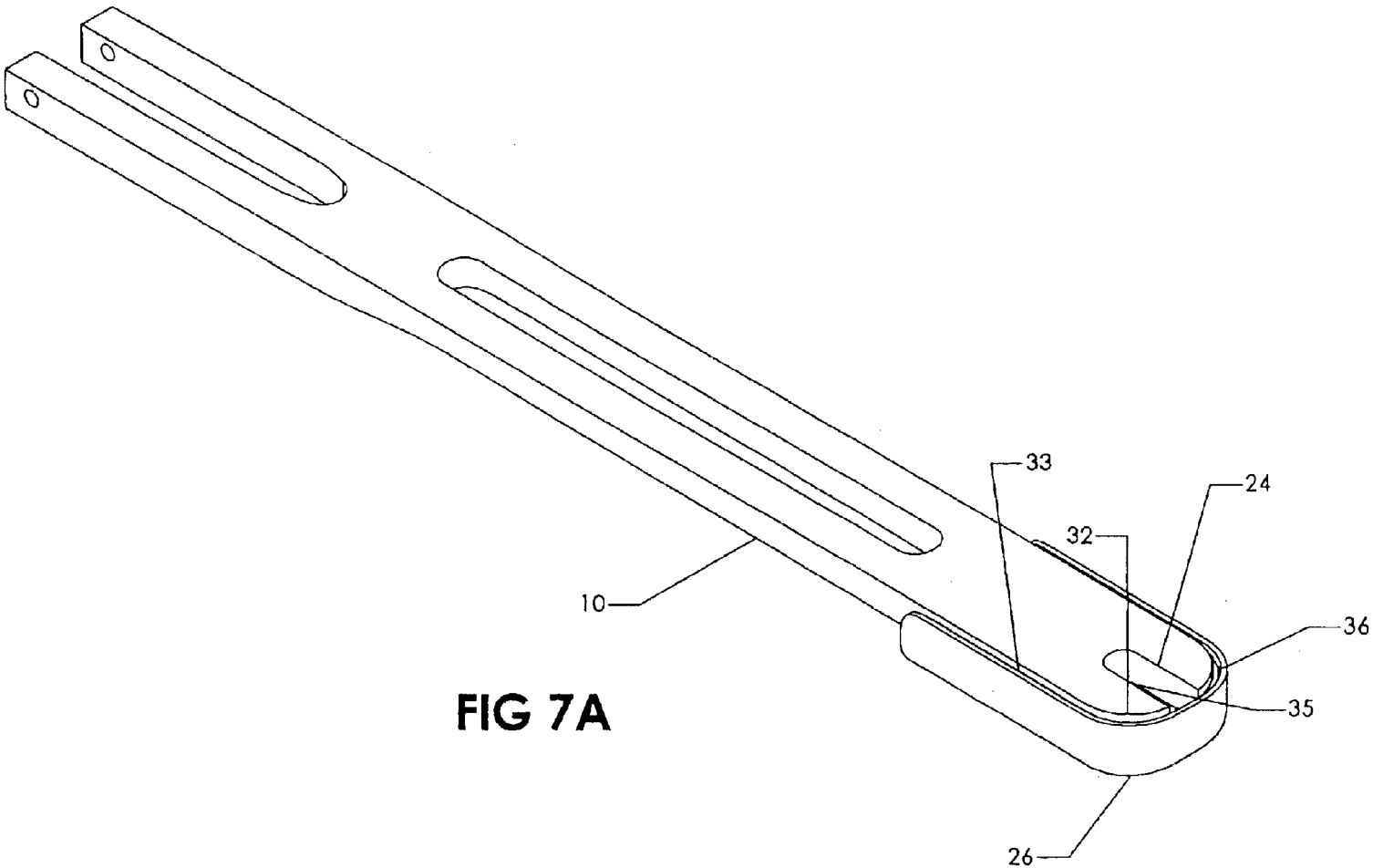
FIG. 7A is a perspective plan view showing the limb end received in the limb cup and limb seat.
Figure 8:
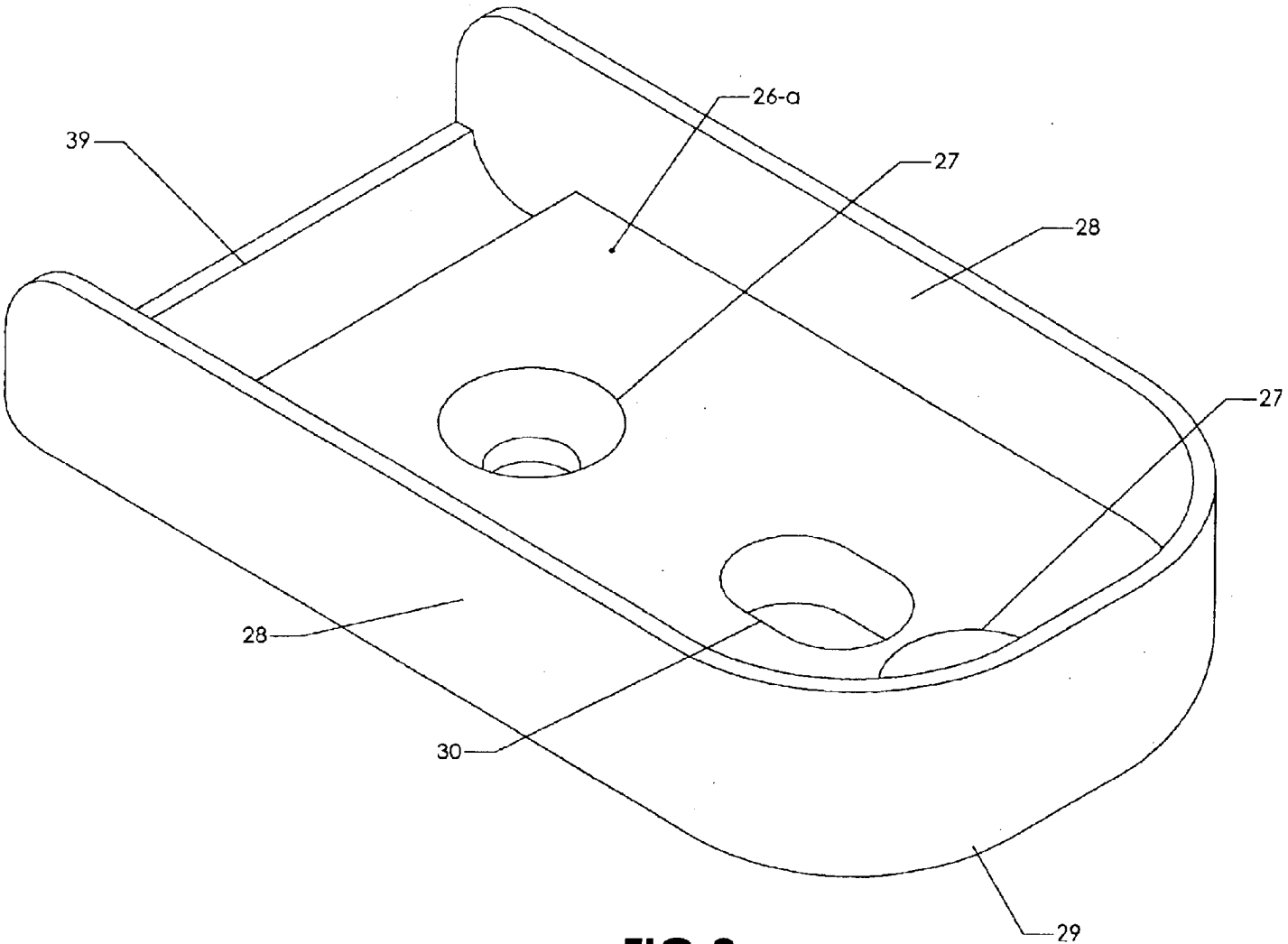
FIG. 8 is a perspective elevational view of the limb pocket component on an enlarged scale.

As shown in FIG. 7, the bolt 31 is part of a fastener assembly which includes an aluminum washer 40 and the polyurethane anti-vibration washer 42, typically having a durometer rating in the 50–60 area. The bolt 31 extends through the slotted opening 24 in the inner end of limb 10 or 11, through slotted opening 35 in the limb cup 32 and 30 in the limb seat 26 and through a slot 12*s* in riser 12 into a polyurethane or similar bushing generally designated 43 having a bolt receiving bore 44 provided therein. Bushings 43 seat snugly within bores 12*e* provided in each end of the riser 12 inboard of each seat 26. Provided embedded within the bushing 43 is a preferably stainless steel cylinder 45

(FIG. 11) having a threaded bolt receiving bore 46 aligning with bore 44. End caps 47 and 48 of greater external diameter than the bushing opening 12*e* (FIG. 7) are received on the reduced ends 43*a* of the bushing 43. The end caps 47 and 48 are preferably adhesively secured to the bushing ends 43*a* and bear against the marginal surface of the riser surrounding the opening 12*e* in which the bushing 43 is received. The durometer of the molded sleeve member 43 with reduced ends 48 may typically be in the area of 70–90. The end cap 47–48 durometer is preferably in the range 30–50. The purpose of the polyurethane sleeve bushing 43 is to dampen recoil vibration transmitted by the attachment bolt 31 and to resist forces tending to twist the handle 12*a*. The bushing 43 and cylinder 45 also resist outward pull of the bolt 31. The provision of the cups 32, which cushion or absorb the recoil of the limbs 10 and 11, prevents much of the recoil vibration from reaching the limb seats 26 and, in addition to preventing torsional forces from reaching the riser and handle, also damps vibration resulting from the flexing of the bow limbs 10 and 11.

Figure 11:
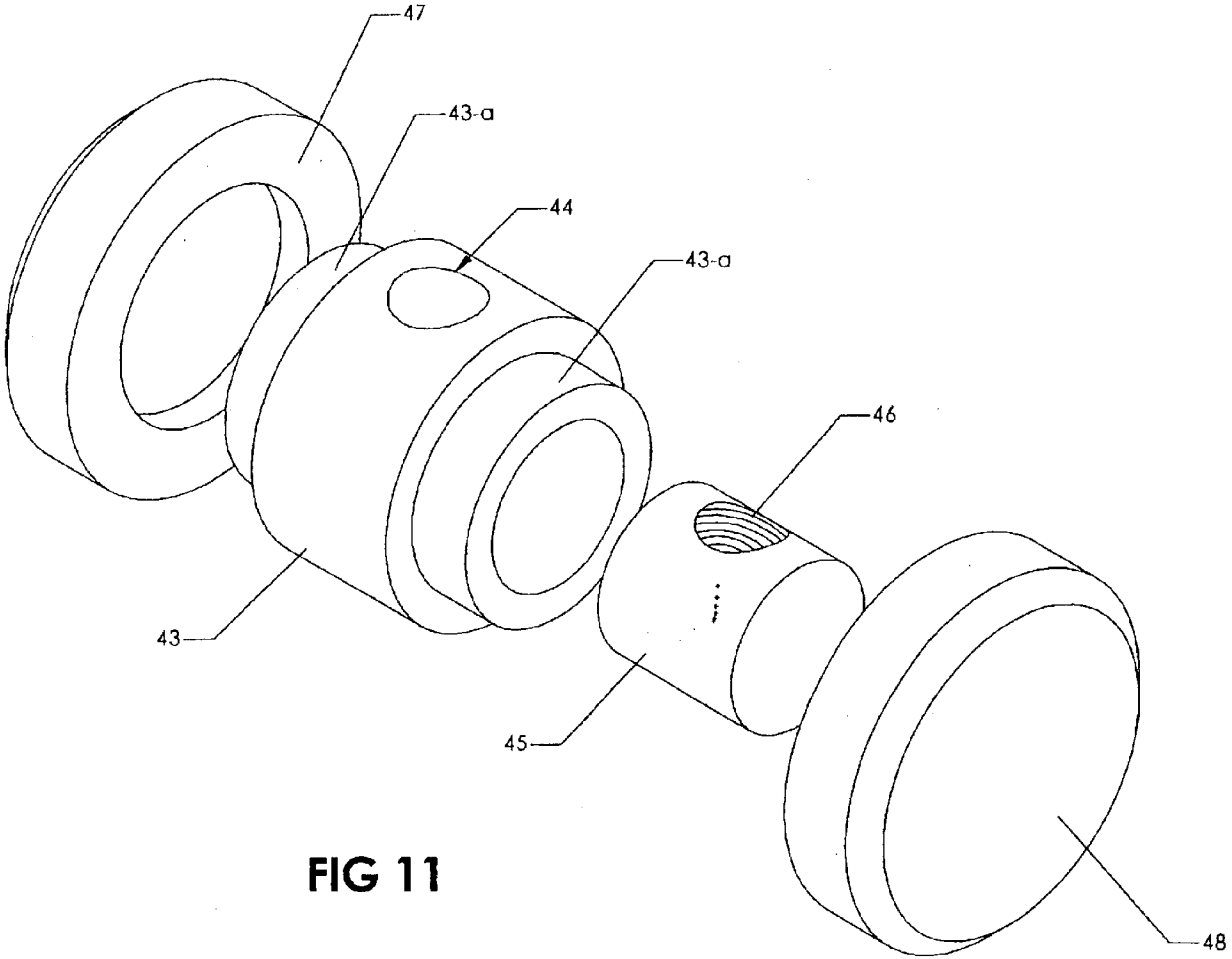
FIG. 11 is an enlarged perspective, exploded view of the limb bolt bushing assembly.
Figure 11A:
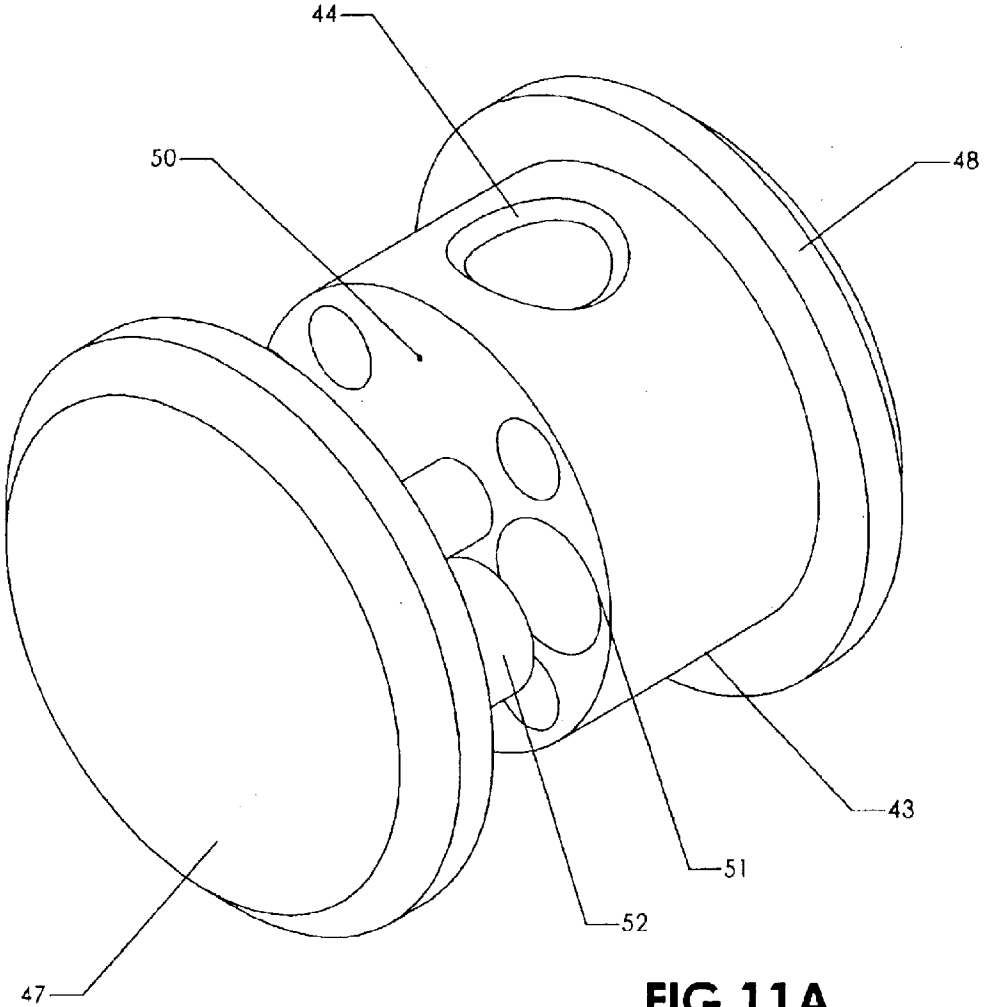
FIG. 11A is a similar view disclosing an alternative embodiment.

In FIG. 11A an improved alternative embodiment is disclosed in which bushing 43 is eliminated and cylinder 45 is formed of "Delrin" plastic as a damping body. The ends of cylinder 45 are closed as at 50 except for openings 51. The openings 51 receive projections 52 extending from cap 47 and cap 48 which may have a durometer rating in the 15–25 range. The noise reducing caps 47 and 48 are preferably adhesively secured to cylinder 45.

Referring now more particularly to FIGS. 12–16 a three cable draw and tensioning system is disclosed wherein novel eccentric cam pulleys are utilized at both ends of the bow. It is to be understood that one of the eccentric pulleys could be replaced by an idler pulley in another modification of the system depicted in these figures. The base cam/power cam device disclosed in U.S. Pat. No. 5,975,067, which I incorporate herein by reference, could be employed as the eccentric pulleys, with the distinction that the base cam and the power cam, which in the patent are continuous, are separated by a shouldered portion which disposes the track in the power cam at a spaced axial distance from the track in the base cam so that the tracks are no longer side by side. The importance of this distinction and the function it achieves will be discussed subsequently. Alternatively, cams of the general nature of those disclosed in U.S. Pat. No. 5,975,067 which include the shouldered portions but not all of the features claimed may be employed.

Figure 12:
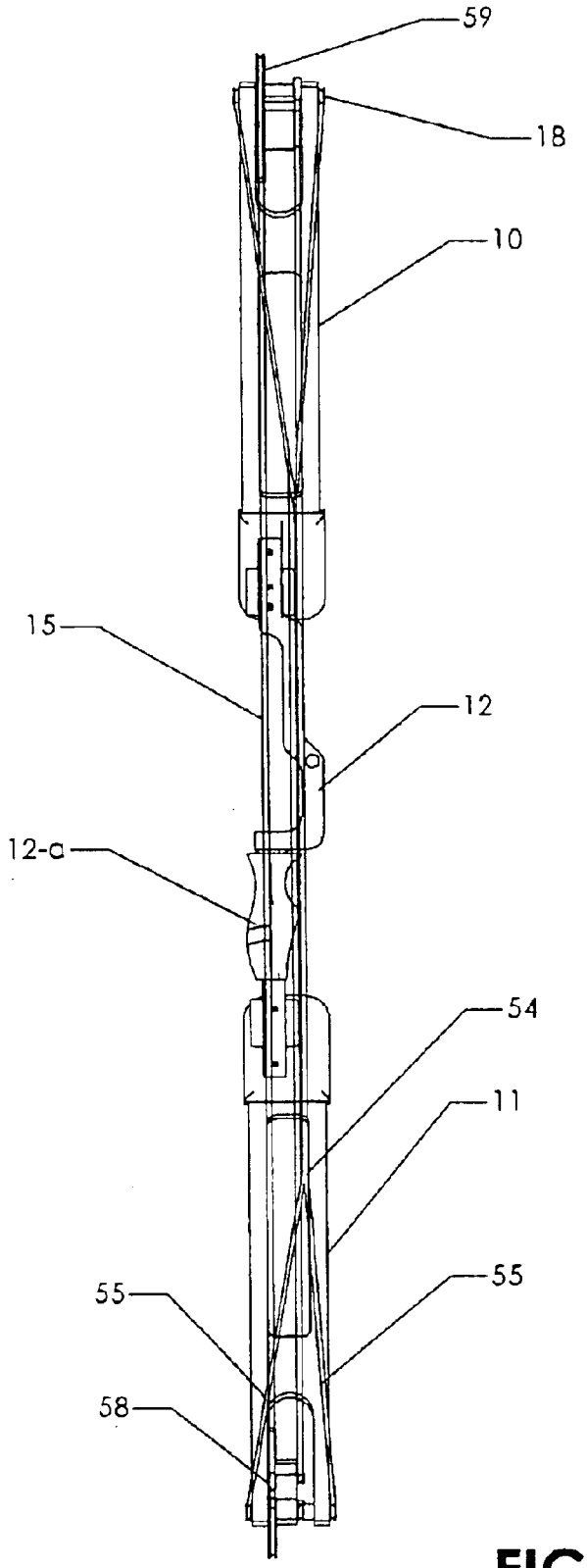
FIG. 12 is a rear elevational view of a bow employing eccentric cam assemblies at each of its upper and lower ends.
Figure 13:
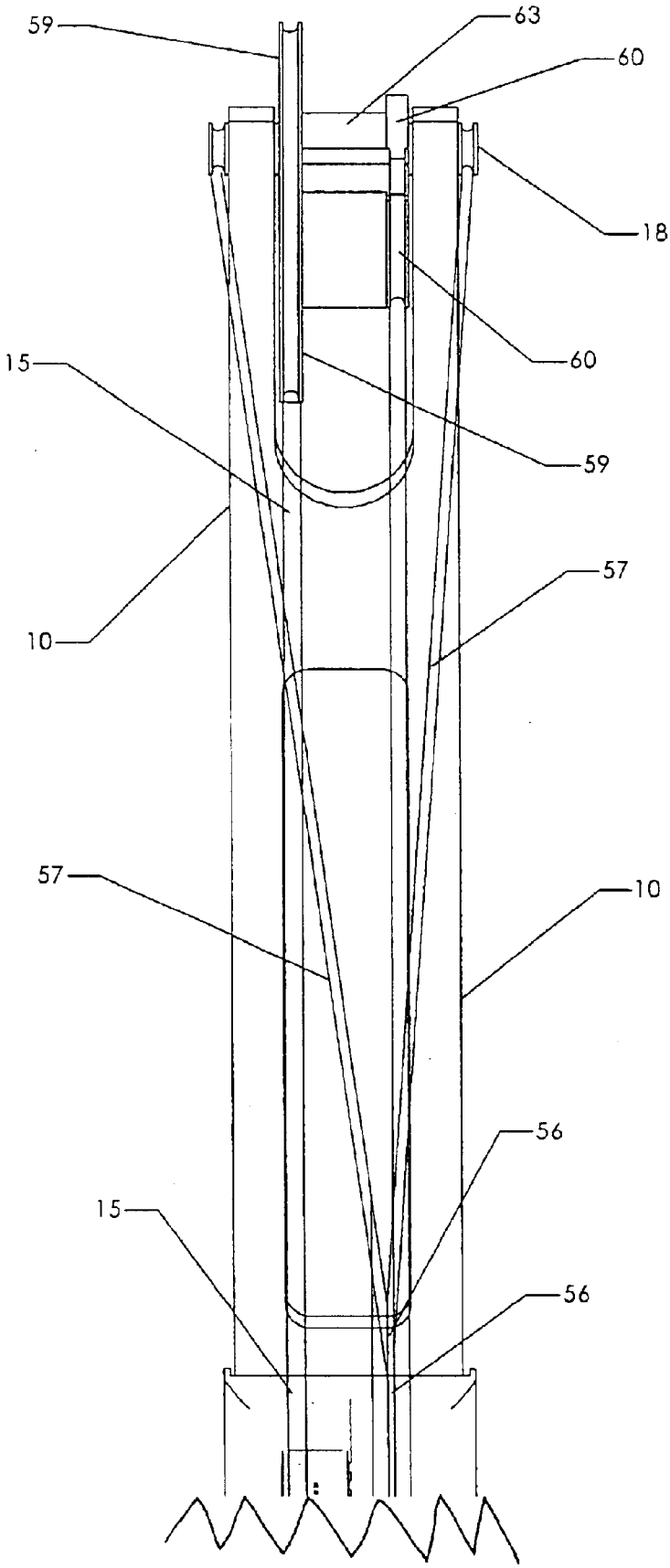
FIG. 13 is an enlarged view of the upper end of the bow shown in FIG. 12.
Figure 14:
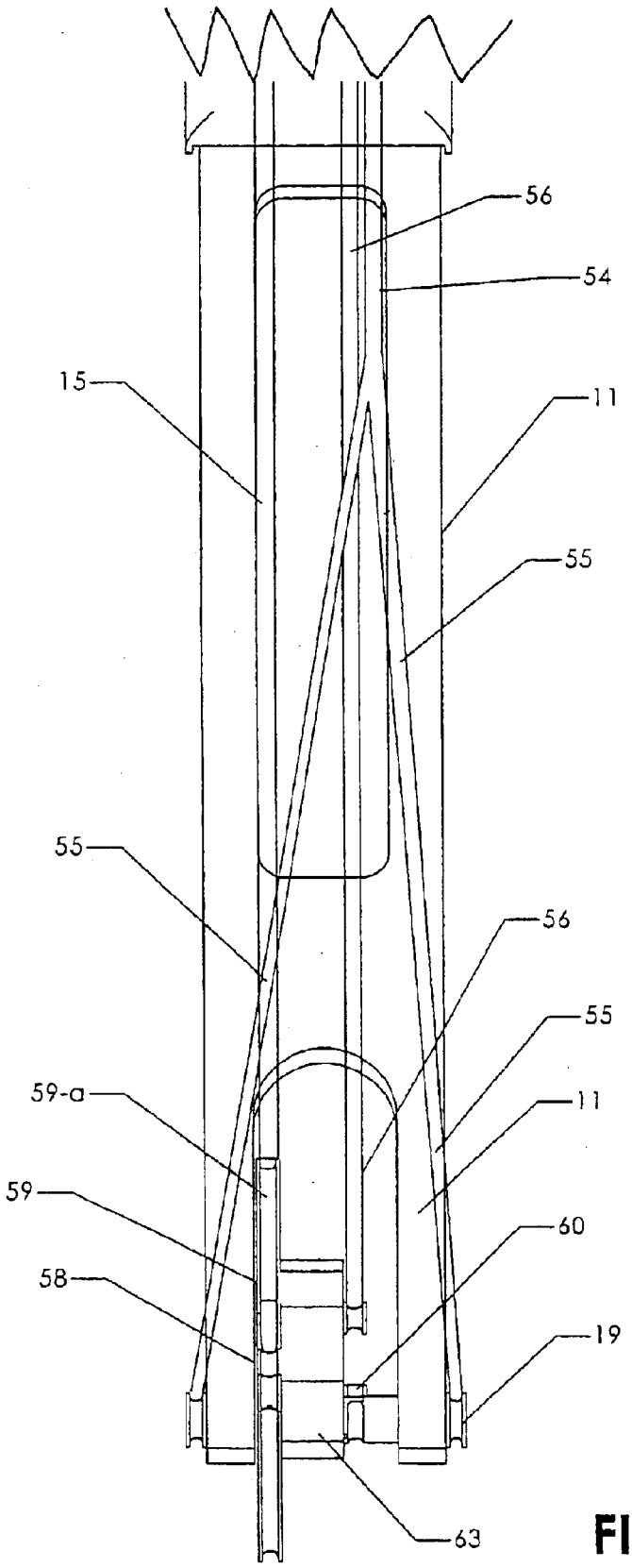
FIG. 14 is an enlarged view of the lower end of the bow shown in FIG. 12.

Turning now more particularly to FIGS. 12–14, where like numerals to designate previous components have been employed, the three cable system used, as illustrated in the drawings, consists of the draw string or draw cable 15, the power cable 54 which has a yoke connection 55 to the ends of the lower axle pin 19 as shown particularly in FIG. 14, and let out/take up cable 56 which has a yoke connection 57 to both ends of the axle pin 18 at the upper end of the bow.

The base cam/power cam assembly generally designated 58 is used at the lower end of the bow and a like base cam/power cam assembly is used at the upper end of the bow. In both instances, the base cam/power cam assembly includes the partially elliptical base cam 59 having a pulley track 59*a* for reception of the draw cable 15 and a power cam 60 having a pulley track 60*a* for reception of one of the cables 54 or 56. The upper eccentric mounts the cable 54, the terminal lower end of the cable 54*a* attaching to a post 61 projecting laterally from the base cam 59, as shown particularly in FIG. 15. The upper base cam/power cam assembly mounts the terminal end of the cable 15 on its post 62 projecting laterally from base cam 59. The lower end base cam/power cam assembly 59 mounts the cable 56 on its attachment projection 61 and the cable 56 has a yoke connection to both ends of the upper axle pin 18.

Figure 15:
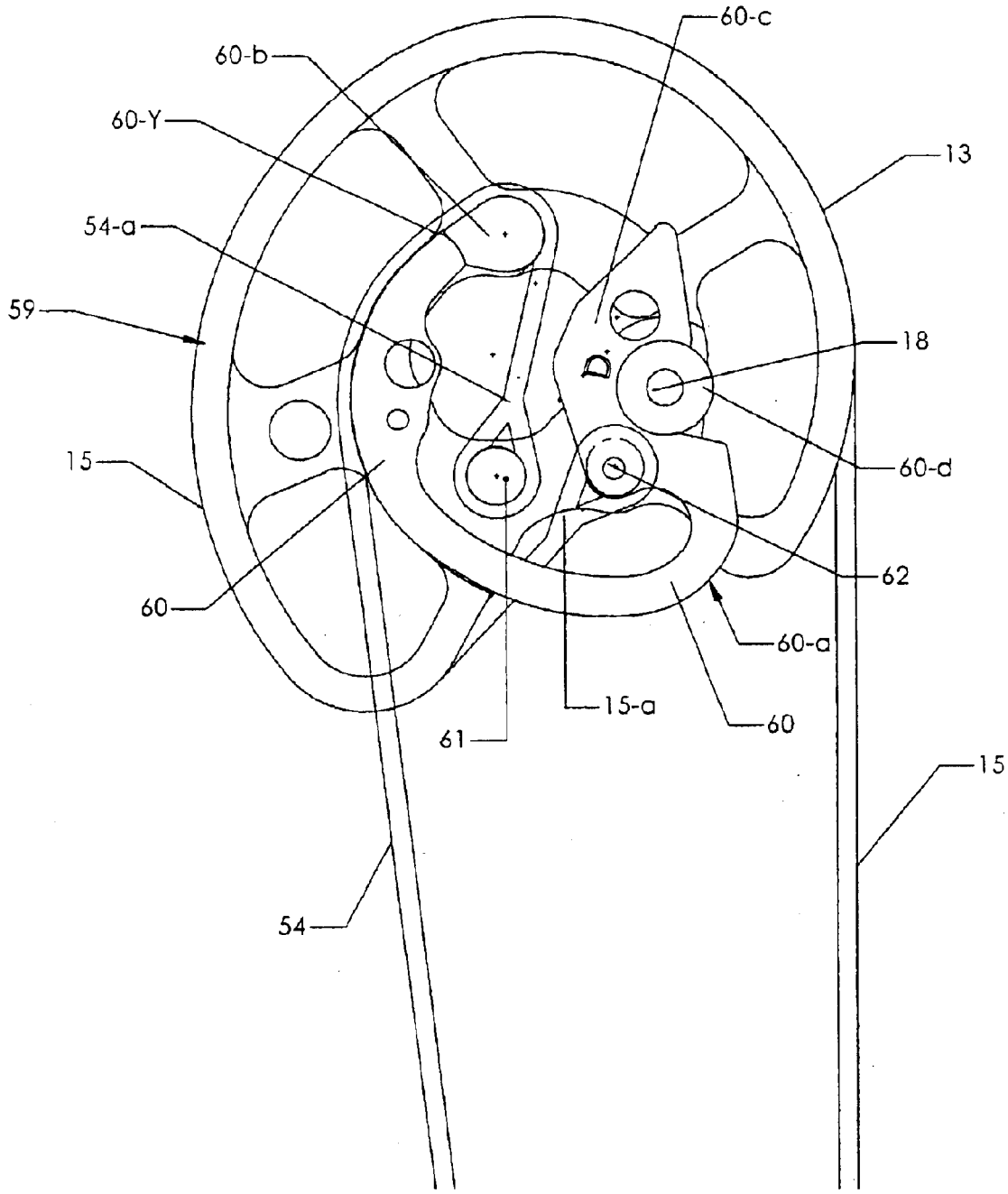
FIG. 15 is a considerably enlarged view of eccentric pulley assembly which may be used at both ends of the bow.
Figure 16:
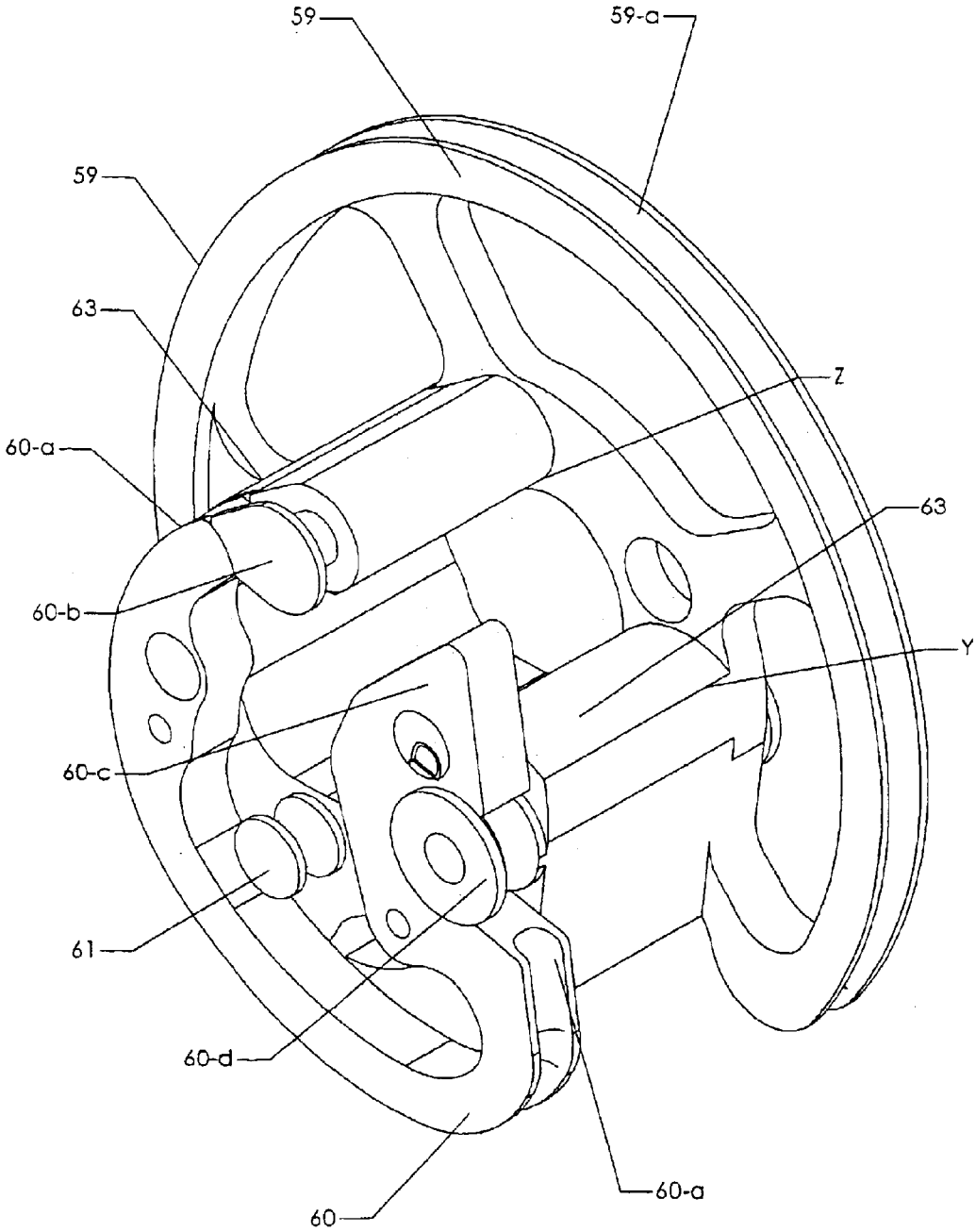
FIG. 16 is an enlarged perspective view of the eccentric pulley assembly only.
Figure 17:
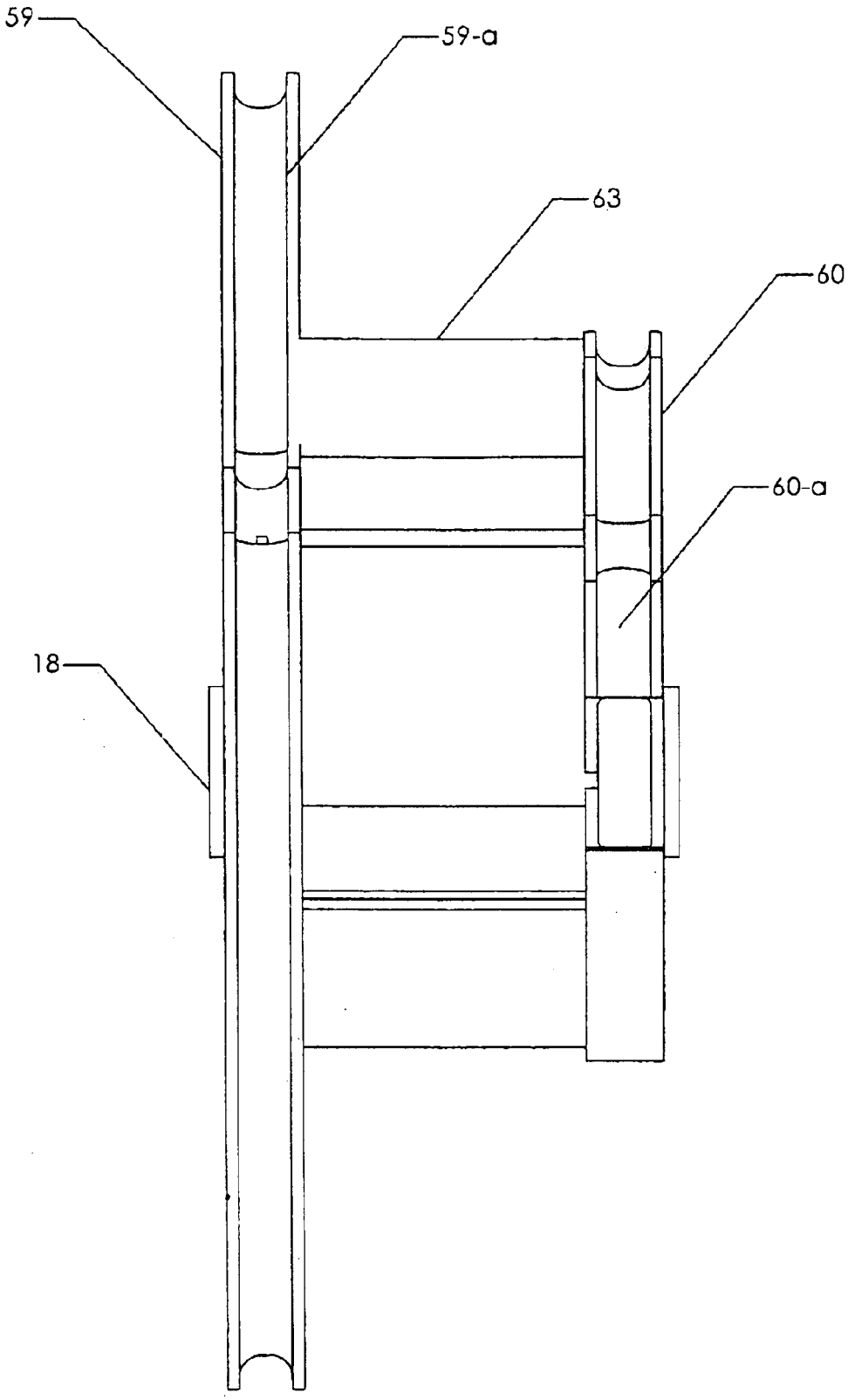
FIG. 17 is an edge elevational view of a base cam/power cam eccentric pulley assembly.

In FIGS. 15–17, the power cam 60 is shown as including an end 60*y* abutting a post 60*b* on base cam 59 and an end 60*c* which embraces a tubular post 60*d* on base cam 59 which is journaled on the pulley pin 18. As previously, the base cam 59 and power cam 60 rotate in unison on the pin 18. The upper terminal end 15*a* of draw cable 15 has a yoke connection 15*a* to a post 62 fixed on the opposite face of the base cam 59 and the lower terminal end has a similar connection to the base cam 59 of the lower eccentric assembly 58. Both the base cam 59 and the power cam 60 are fixed to one another to move eccentrically about the pivot post 18 at the upper end of the bow, or 19 at the lower end of the bow. Where previously the base cam 59 and the power cam 60 have been side by side or adjacent to one another, they now are separated by a shoulder or axial projection 63 fixed on the base cam pulley 59. This projection 63 which extends clockwisely from y to z substantially around power cam 60 in FIG. 16 reduces twisting forces and assures that the base cam/power cam assemblies will lie in vertical alignment. The projection 63 is not necessarily clockwisely continuous and may be sectionalized. Generally speaking, the axial projection of the shoulders 63 will be in the neighborhood of 0.5 to 1.25 inches around a substantive portion of the extent of the power cam 60. In the lower part of the range, one of the shoulders 63 on the upper and lower eccentric pulleys will normally be at least sufficiently different in projection extent to best maintain cable separation. In the right hand bow depicted the projection 63 at the lower end of the bow will be the longer projection. In a left hander's bow, this will be reversed. When a sufficiently long shoulder projection in the neighborhood of 0.75 to 1.25 inches is provided, the cable guard rod r shown in FIG. 1 can be eliminated because the projections 63 on the eccentric pulley assemblies 58 hold the cables 56 and 54 sufficiently apart so that they do not touch one another or imperil the arrow feathers when the arrow is released. In the embodiment where an idler pulley is used in place of the upper eccentric, a hub part, of selected axial projection inwardly, may be used to locate the idler pulley track in vertical alignment with the lower eccentric base cam track.

The Operation

When the draw weight of the bow is adjusted via bolts 31, the limbs 10 and 11 are free to flex or unflex with respect to bolts 31 slightly because of the slots 24, 30, 35, and 12*s*. The inner ends of limbs 10 and 11 are restricted resiliently by walls 34 from all but very limited, flexural movement inwardly. In operation, as the bow string 15 is pulled rearwardly to its position of maximum weight at mid-draw against the resistance of cable system TC, the limbs 10 and 11 will flex or curve in the usual manner and the cups or liners 33 will cushion the return from deflection when the arrow is released and the limbs 10 and 11 recoil. With the cups 32 constructed of a semi-rigid resilient anti-vibration material, the transfer of stresses to the limb seats or pockets and riser is dampened because the upstanding walls of the cups 32 are snugly received by the upstanding walls of the metallic limb seats and limb recoil vibration and noise is isolated. Any tendency of the limb cups 32 to rotate and impose torsional forces is also reduced and dampened because the walls 33 are snugly in engagement with the walls 28, and walls 29 are snugly in engagement with the walls 34. The limbs 10 and 11 are not of a thickness to project above the cup walls 33 and 34. The provision of the washers 42 and the bushings 43 or the synthetic plastic vibration damping cylinder 45 with anti-vibration end caps 47–48 further damps the vibration which occurs at the moment of arrow release. The fact that the bow string 15 is in vertically centered relationship results in less torsional force being imposed on the limbs 10 and 11 and the centering of the arrow top to bottom provides greater accuracy in the shot.

Method of Construction

In constructing the bow, a normal first step is to secure the bow seats 26 to the opposite ends of the riser 12 by means of bolts 25, with the riser surfaces 12*f* fitting within the bottom recesses 26*b* in cups 26 and the openings 12*s* and 30 in alignment. Next the limb cups 32 are snugly fitted within the limb seats 26, and the limbs 10 and 11 are inserted with the slots 24 in alignment with the limb cup openings 35 which are aligned with the pocket openings 30. The anti-vibration members 43 are next inserted in the openings 12*e* with the openings 44 and 46 aligned with openings 12*s,* and caps 47 and 48 are then adhesively secured in position on opposite sides of the riser 12. With the metallic washer 40 and the anti-vibration washer 42 in place on the bolts 31, each bolt 31 is extended through the slotted openings 24, 35, 30 and 12*s* into the bushing opening 34 and threaded into threaded opening 46. Then, the handle 12*a,* cable guard rod r, pulleys and axles, and the string and tension cable system TC may be installed in the usual manner.

The disclosed embodiment is representative of a presently preferred form of the invention, but is intended to be illustrative rather than definitive thereof. The invention is defined in the claims.

What is claimed is:

1. An eccentric pulley assembly for a compound bow adapted to be revolvably mounted on one of the limbs thereof comprising:

(a) an eccentric base cam having a peripheral track for letting out a draw string trained on said track when the base cam rotates as the bow is drawn, said base cam having an offset rotation axis substantially perpendicular to the plane of the base cam;

(b) a power cam secured to said base cam and having a cable track for taking up a power cable as the bow is drawn, said power cam having an offset axis of rotation perpendicular to the plane of the power cam coincident with said axis of rotation of the base cam;

(c) an attachment on said assembly for one end of said power cable or one end of a let out/take up cable; and (d) a laterally projecting shoulder on one of said base cam and power cam laterally spacing said track on the base cam from the track on said power cam to relatively position said tracks.

2. A method of making a compound archery bow comprising a handle-providing rigid riser with opposite ends, flexible limbs having inner ends secured to the riser and outer ends mounting eccentric pulley assemblies with vertically aligned tracks around which a draw string is trained, comprising:

(a) providing each eccentric pulley assembly as an eccentric base cam having a peripheral track for letting out a draw string trained on said track when the base cam rotates as the bow is drawn, said base cam having an offset rotation axis substantially perpendicular to the plane of the base cam; a power cam secured to said base cam and having a cable track for taking up a power cable as the bow is drawn, said power cam having an offset axis of rotation perpendicular to the plane of the power cam coincident with said axis of rotation of the base cam; an attachment on said assembly for one end of said power cable or one end of a let out/take up cable; a laterally projecting shoulder on one of said base cam and power cam laterally spacing said track on the base cam from the track on said power cam to relatively position said tracks; and (b) providing a greater axial extension of said shoulder on one of said eccentric pulley assemblies than on said other pulley assembly.

* * * * *